United States Patent [19]

Bruno

[11] Patent Number: 4,670,926

[45] Date of Patent: Jun. 9, 1987

[54] PAPER KNIFE AND STAPLE PULLER HEAD

[76] Inventor: Mario Bruno, Via Pettinengo 12, Turin, Italy

[21] Appl. No.: 908,856

[22] Filed: Sep. 18, 1986

[51] Int. Cl.[4] ..... B25F 1/00

[52] U.S. Cl. ..... 7/160; 254/28

[58] Field of Search ..... 7/160, 158, 169, 170; 254/28; D8/48, 19, 20; 30/DIG. 3; D19/72, 95

[56] References Cited

U.S. PATENT DOCUMENTS

D. 134,478 12/1942 Lockett ..... D19/72

574,563 1/1897 Nelson et al. ..... 30/DIG. 3

1,515,952 11/1924 Joell ..... 30/DIG. 3

*Primary Examiner*—Roscoe V. Parker

*Attorney, Agent, or Firm*—Pollock, Vande Sande & Priddy

[57] ABSTRACT

A paper knife and staple puller head formed by a thin razor type blade having a cutting edge directed towards the interior, and by a non-cutting guide member arranged at a certain angle in front of the cutting edge of the blade. The guide member terminates with an upwardly directed point, thus forming a staple puller. This head can be applied to a handle body of the paper knife type or to a pocketable body of reduced dimensions.

5 Claims, 4 Drawing Figures

PAPER KNIFE AND STAPLE PULLER HEAD

BACKGROUND OF THE INVENTION

This invention relates to a paper knife head of the type for continuous cutting and associated with a staple puller.

At present staple pullers are generally made in the form of office tweezers and, on the other hand, it is often necessary to have at one's disposal a staple puller, even if only a casual one, somewhere else.

As casual staple pullers generally various articles are used that can be found around the place or in one's pocket.

Also the problem of paper knives is equally well known: normally a paper knife is constituted by a long blade having rounded edges for safety reasons and secured to a handle.

These paper knives, too, are typical office articles; it is difficult to have at one's disposal a paper knife somewhere else, even if one would wish to have one, for example, for opening envelopes or small paper mail packets.

It is an object of the present invention to eliminate these disadvantages by providing a simple and practical device that will combine the two functions by providing an improved paper knife for continuous cutting together with a staple puller.

Further advantages of the present invention consist in that due to the conception of the paper knife head for continuous cutting, the cutting effort is reduced to a minimum with a rapid cutting action, the cutting blade is small and not bulky, and the staple puller is incorporated in the paper knife head, so that the device may also be made in the form of a pocket device.

SUMMARY OF THE INVENTION

The main characteristic of the present invention consists in that the head of the paper knife and staple puller is constituted by a thin razor type blade having a cutting edge directed towards the interior of the head, and a non-cutting guide member arranged at a certain angle in front of the cutting edge of the blade, the guide member terminating with a slightly upwardly bent point, thus providing a staple puller.

A further characteristic of the present invention consists in that the guide member arranged at a certain angle in front of the cutting edge is constituted by a plane flat portion of a support to which the cutting blade is secured, and by the upwardly bent pointed portion of this support or actual staple puller lancet.

It is to be noted that the guide member of the present device which is constituted by the plane flat portion of the support and the upwardly directed portion of this support, considerably contributes to the efficiency of the device by providing a guide element that has a sufficient height in comparison with the envelope or sheet to be cut without this height being due to the thickness of the blade of the support.

DESCRIPTION OF PREFERRED EMBODIMENT

Figure 1:
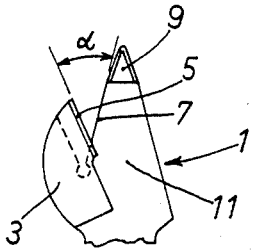
FIG. 1 is a plan view of a paper knife and staple puller head, according to the invention.
Figure 2:
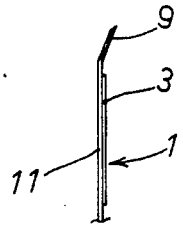
FIG. 2 is a side elevational view of FIG. 1.

As shown in FIG. 1, a head 1 of a paper knife and staple puller according to the invention is substantially constituted by a razor type thin blade 3 having a cutting edge 5 directed towards the interior of the head 1, and by a non-cutting guide member 7 arranged in front of the cutting edge 5 of the blade 3 at a certain angle $\alpha$.

The guide member 7 terminates with a slightly upwardly bent point 9 to provide a convenient and efficient staple puller.

Thus, the guide member 7 is composed of a plane flat portion 11 and an inclined portion or point 9. The portions 9 and 11 together constitute a guide element that is sufficiently high in comparison with the envelope or sheet to be cut without this height being due to the thickness of the blade of the support or guide member 7.

Figure 3:
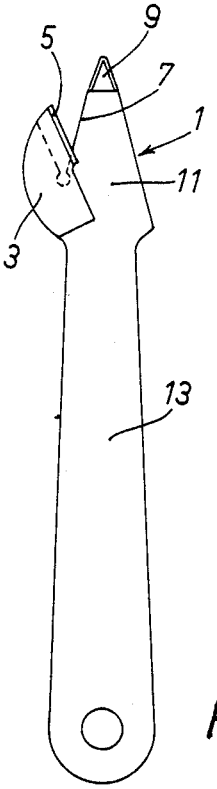
FIG. 3 is a view of an embodiment of an object to which the present paper knife and staple puller head has been applied.

FIG. 3 illustrates an embodiment of an object to which the head 1 has been applied. In particular, in FIG. 3 the device is constituted by a head 1 formed integrally with a handle or handgrip 13. Obviously the handle may in turn be inclined, aligned or shaped, but this is not directly related to the present invention.

Figure 4:
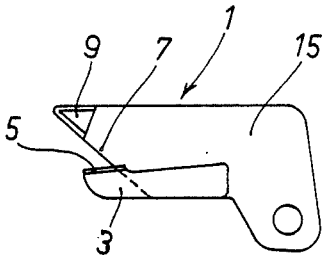
FIG. 4 is a view of another embodiment of an object to which the present head has been applied, in particular a pocketable object.

FIG. 4 shows another pocketable embodiment of the present paper knife and staple puller head. In FIG. 4 the head 1 is secured to a small body 15 to provide a paper knife and staple puller in the form of a pocket device.

To facilitate the operation of pulling out the staples, a small flare with a circular recess (not shown in the drawings) may be provided on the lancet point 9, this flare being formed to mate the pointed end of the staple and remove it without slipping.

Finally, to prevent the device, especially in the pocket version, from causing damage (cutting) to the user or his pockets, the head is provided with an appropriate covering element (not shown) which is rotatably mounted on the plane portion 11 or 15 of the guide member 7 to cover the cutting edge 5 by rotating it.

Although a preferred embodiment of the invention has thus been described in detail with reference to the accompanying drawings, it is to be understood that the invention is not limited to this precise embodiment and that numerous changes and modifications obvious to one skilled in the art may be made therein without departing from the scope of the invention as defined by the appended claims.

I claim:

1. A paper knife and staple puller head comprising a thin razor type blade having a cutting edge directed towards the interior of said head, and a non-cutting guide member arranged at an angle in front of said cutting edge of said blade, said guide member terminating with a slightly upwardly bent point, thus providing a staple puller device.

2. A paper knife and staple puller head as claimed in claim 1, wherein said cutting angle of said head, located between said cutting edge of said blade and an adjacent edge of said guide member, is an acute angle.

3. A paper knife and staple puller head as claimed in claim 1, wherein said guide member arranged at an angle in front of said cutting edge is formed by a plane flat portion of a support and said cutting blade is secured to said support, said guide member being further formed by an upwardly bent pointed portion of said support constituting said staple puller head.

4. A paper knife and staple puller head as claimed in claim 1, wherein said head is formed integrally with a handle body of a conventional paper knife type.

5. A paper knife and staple puller head as claimed in claim 1, wherein said head is formed integrally with a pocketable body of reduced dimensions.

* * * * *